US006890083B2

(12) United States Patent
Cochran

(10) Patent No.: US 6,890,083 B2
(45) Date of Patent: May 10, 2005

(54) UNDERWATER PROBE AND ILLUMINATION DEVICE

(76) Inventor: Dennis Cochran, 560 Ridgemount Dr., El Paso, TX (US) 79912

( * ) Notice: Subject to any disclaimer, the term of this patent is extended or adjusted under 35 U.S.C. 154(b) by 29 days.

(21) Appl. No.: 10/093,477

(22) Filed: Mar. 11, 2002

(65) Prior Publication Data

US 2003/0169591 A1 Sep. 11, 2003

(51) Int. Cl.[7] ..... B25B 23/18

(52) U.S. Cl. ..... 362/119; 362/120; 362/109; 362/115; 362/399; 362/400; D26/45; D26/48; D26/50; D26/197

(58) Field of Search ..... 362/119, 120, 362/109, 115, 399, 400; D26/45, 48, 50, 197

(56) References Cited

U.S. PATENT DOCUMENTS

| | | | | |
|---|---|---|---|---|
| 1,765,076 A | | 6/1930 | Jung | |
| 2,358,576 A | | 9/1944 | Jackell | |
| 2,358,867 A | | 9/1944 | Maden | |
| 2,561,122 A | | 7/1951 | Juergens | |
| 4,151,583 A | | 4/1979 | Miller | |
| 4,314,575 A | | 2/1982 | Kuo | |
| 4,501,555 A | | 2/1985 | Ditchburn | |
| 4,669,186 A | | 6/1987 | Liu | |
| 4,751,621 A | | 6/1988 | Jenkins | |
| 5,001,608 A | * | 3/1991 | Kehrli et al. | 362/19 |
| 5,003,437 A | * | 3/1991 | Barrett | 362/109 |
| 5,144,481 A | | 9/1992 | Pettito, Sr. | |
| 5,226,718 A | | 7/1993 | Lin | |
| 5,402,575 A | | 4/1995 | Maxcy | |
| 5,611,615 A | | 3/1997 | Jang | |
| 5,685,586 A | | 11/1997 | Miller | |
| 5,913,671 A | | 6/1999 | Fernandez et al. | |
| 5,967,638 A | | 10/1999 | Gorman, Jr. et al. | |
| 6,099,138 A | | 8/2000 | Cardan | |
| 6,361,194 B1 | * | 3/2002 | Evans et al. | 362/399 |

* cited by examiner

*Primary Examiner*—Stephen Husar
*Assistant Examiner*—Bertrand Zeade
(74) *Attorney, Agent, or Firm*—Shlesinger Arkwright & Garvey LLP

(57) ABSTRACT

An underwater probe and illumination device comprising an arcuate body having a probe and light positioned at one end of the body and a hand grip at a second end of the body, the body is tapered from the hand grip to the probe tip and also includes a second hand grip disposed between the ends of the body.

17 Claims, 3 Drawing Sheets

FIG.5
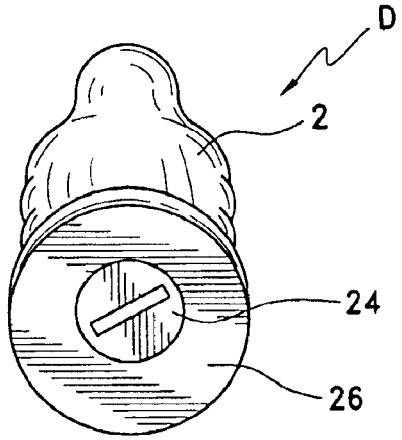
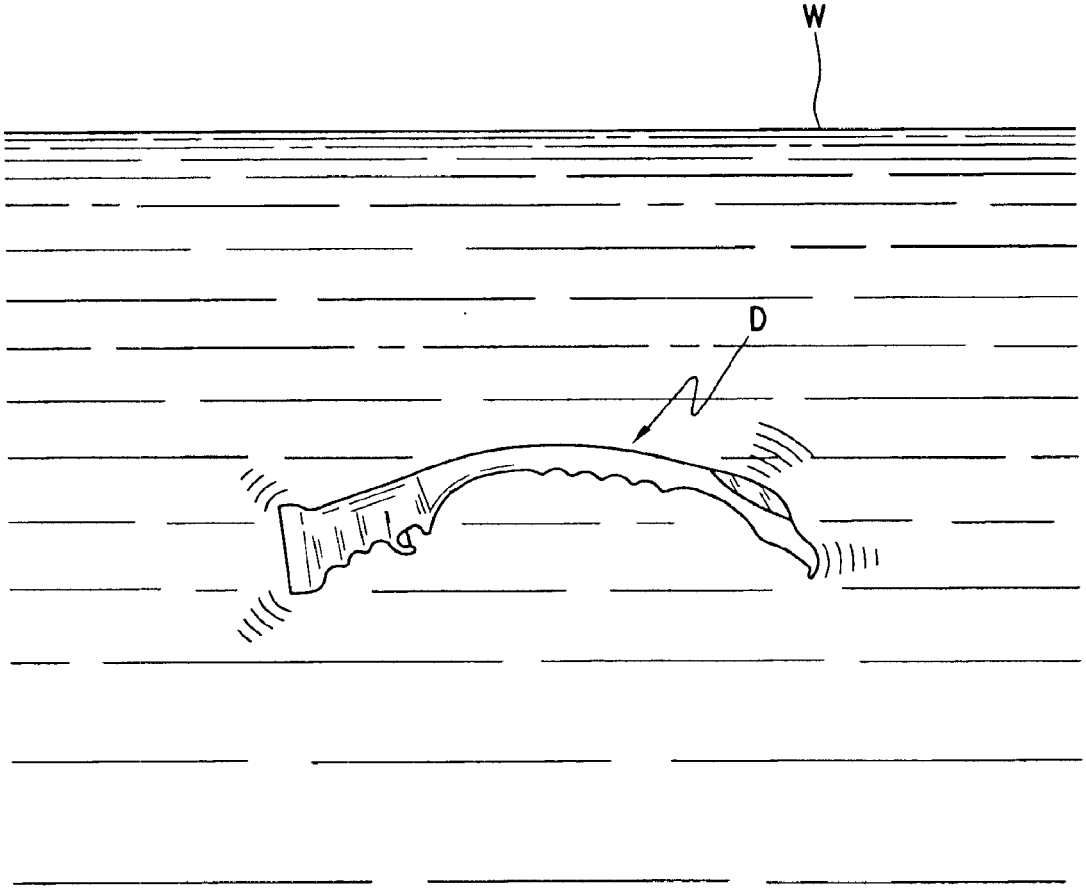
FIG. 6

UNDERWATER PROBE AND ILLUMINATION DEVICE

FIELD OF THE INVENTION

The present invention generally relates to underwater tools and more specifically to a hand held probe combined with an illumination light for use by drivers.

BACKGROUND OF THE INVENTION

Underwater activities such as diving often require a participant carry a tool or other device that is especially adapted for the undersea environment. For example, it is known for a diver to carry a flashlight so that illumination is possible in low light situations. Another useful device is the so-called diving rod or probe which may comprise an elongated member having a handle at one end and a hook at an opposite end. The device is held in the hand of the diver and the hook may be inserted into crevices or underneath rocks thereby eliminating the need to reach into risky areas by hand. In addition, such probes may be used to fend off aggressive sea life or simply assist the diver in traversing along reefs, rocks or wrecks by hooking onto a structure and allowing the diver to draw himself or herself forward through the water.

Prior art underwater flashlights and probes and not satisfactory. Prior art underwater flashlights are bulky and cannot be inserted into small crevices or openings within a reef or undersea structure. Second, it is difficult for a diver to comfortably grasp a prior art flashlight since they usually comprise a single hand grip configured to receive either one or the other hand of the diver, the hand grip extending perpendicular to the flashlight body. Consequently, when holding such flashlights, it is necessary for a diver to use constantly switch hands to alleviate strain. Prior art probes are likewise uncomfortable and cannot be easily held for extended periods of time. This is because prior art probes are not ergonomically shaped or fitted to be received within the hands of the diver. The body of a prior art probe generally comprises a straight pole or rod which when held by either or both hands of the diver will cause strain on the wrists of the user. As a result, the probe cannot be held comfortably for any extended length of time.

In addition, prior art probes are often unevenly weighted, especially at the probe end located distal to where the hand grip is. Consequently, prior art probes are often unwieldy and difficult to manipulate and/or maintain in a horizontal position during underwater. Also, the lack of weighting at the distal or probing end means there is less force generated at the end of the probe while probing. Further, if the prior art probe or underwater light is accidentally released from the hand of the diver during use, the uneven weighting will often cause the device to spiral downward and away from the diver and possibly be lost.

Finally, there are no prior art underwater probes provided with illumination features nor underwater flashlights provided with a probe.

BRIEF DESCRIPTION OF THE DRAWINGS

FIG. 5 is a rear view of the underwater probe shown in FIG. 1; and

FIG. 6 illustrates a probe according to the present invention that has been released from the grasp of a user when underwater.

DETAILED DESCRIPTION OF THE PREFERRED EMBODIMENTS

Figure 1:
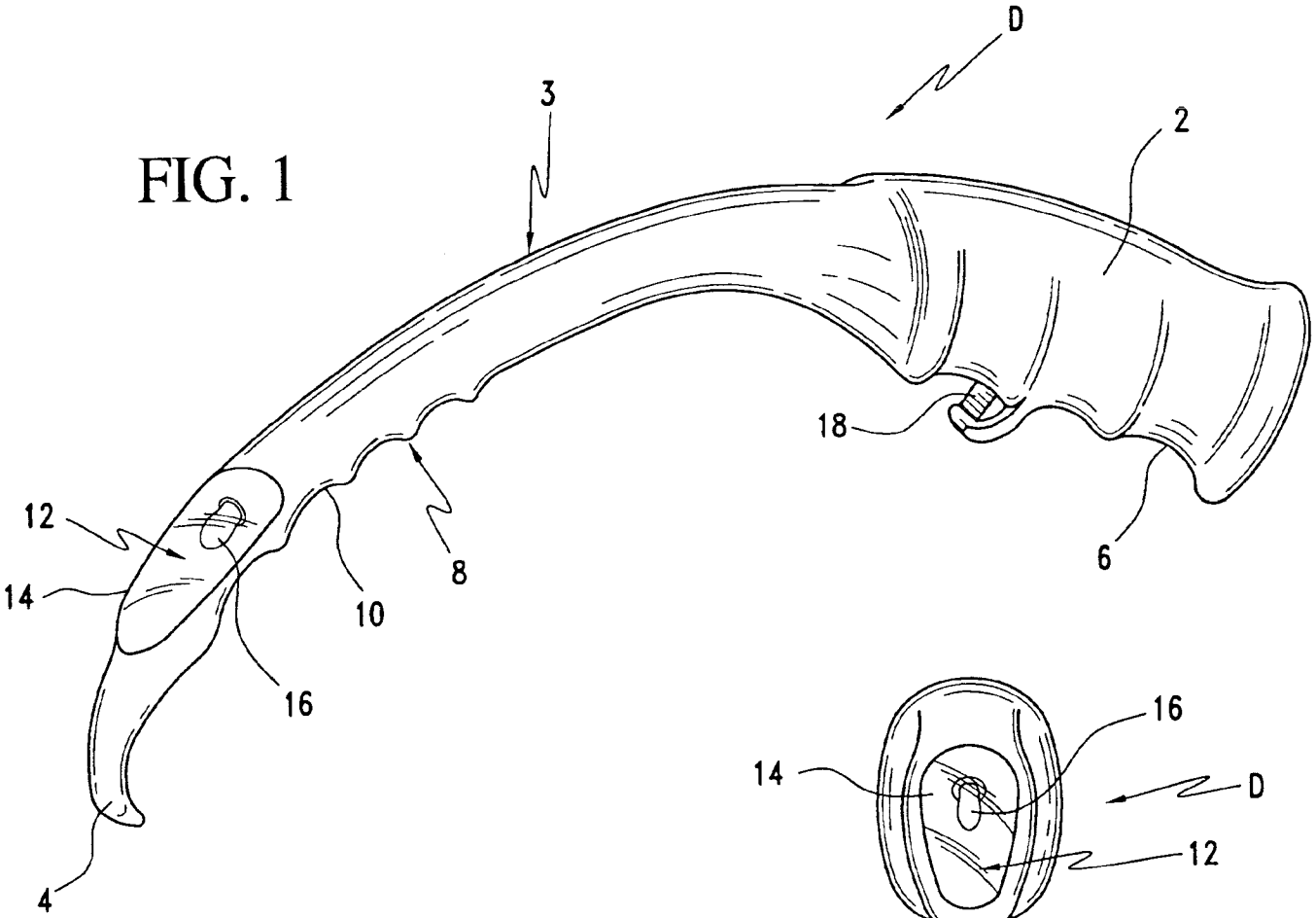
FIG. 1 is perspective view of an underwater probe according to the present invention.
Figure 4:
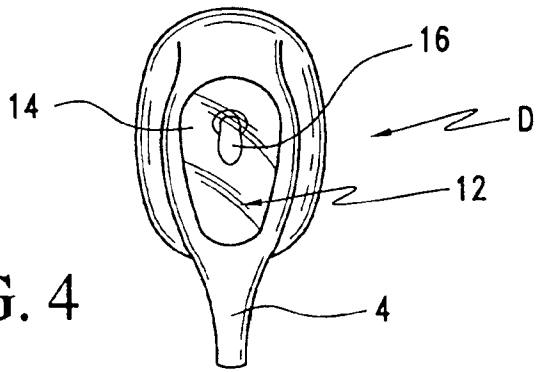
FIG. 4 is a front view of the underwater probe shown in FIG. 1.
Figure 2:
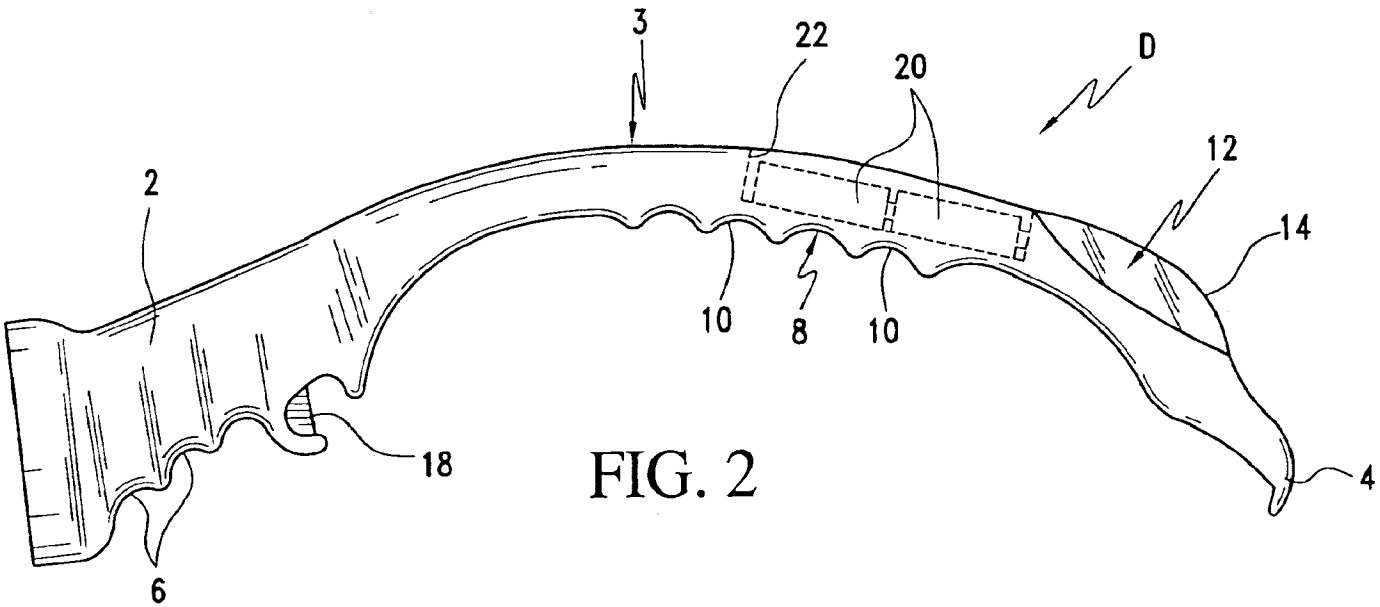
FIG. 2 is a side elevational view of the underwater probe according the present invention and showing the battery housing and batteries in phantom lines.
Figure 3:
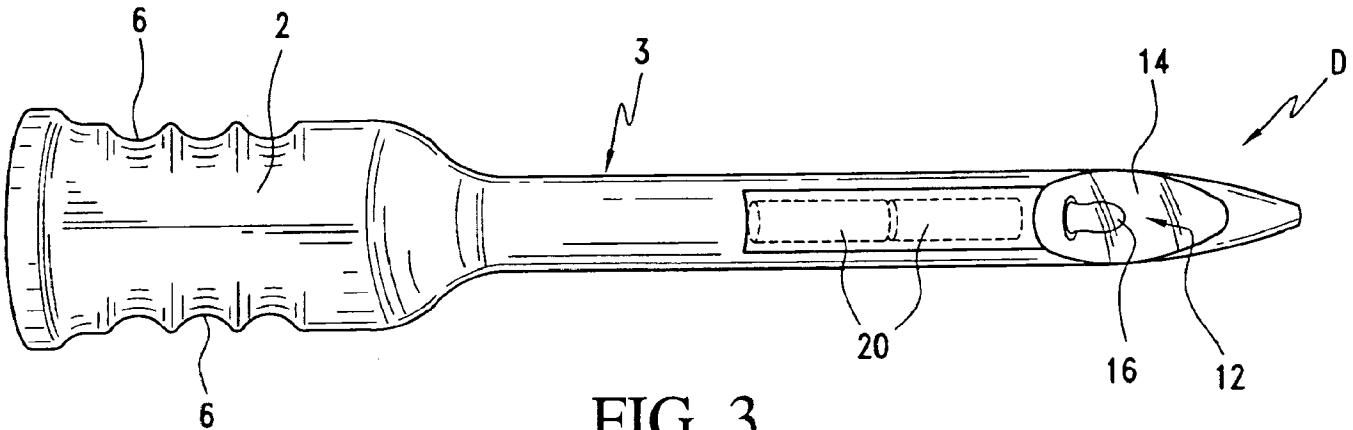
FIG. 3 is a top plan view of the underwater probe according to the present invention and showing the battery housing and batteries in phantom lines.

FIGS. 1 through 5 illustrate the probe and illumination device D according to the present invention. The device D is shown to comprise a generally elongated body, the body having a diameter shown to taper along a midsection 3 from a first end having a widened hand grip 2 and towards a second end having a hook shaped probe portion 4, the probing portion 4 being disposed at the opposite end of the body and distal to hand grip 2. As is apparent, shapes other than a hook for the probe portion are within the scope of the present invention. In addition, and as best shown in FIGS. 1 and 2, the body of the device D has an arcuate shape which extends from hand grip 2 to the hook shaped probing portion 4. The arcuate shape is for ergonomic purposes as will be explained in greater detail below.

The hand grip 2 is preferably provided with an ergonomic shape or design and in the drawings this ergonomic shaping may take the form of concave finger grip portions 6. In a preferred embodiment, the length of device D is about fifteen to about sixteen inches; however, the overall length may varied without departing from one object of the invention, namely, to have a sufficient length and diameter so that the probe end of the device D may be readily inserted into thin crevices located on the reef or some other undersea structure.

Returning to the drawings and in particular FIGS. 1 and 2, the device D is shown to include a second hand grip 8 disposed along the reduced diameter region of the body and forward of the widened hand grip 2, each of the widened and second hand grips 2 and 8 being located along a different regions of the arcuate shaped body. Second hand grip 8 has a diameter less than that of widened hand grip 2 and includes finger grip portions 10 for purposes of comfort. The provision of the widened hand grip 2 separate from a second hand grip 8 enables the device D to be held by the user with either a single hand or with both hands. Further, the provision of the separate hands grips 2 and 8 along different locations of an arcuate body provides a hand grip alignment that is more comfortable and functions to reduce fatigue during use, particularly in the wrists of the diver.

FIG. 5 illustrates a threaded cap 24 disposed within an end portion 26 of hand grip 2. Removal of the threaded cap will permit access to a storage compartment (not shown) provided for purposes of receiving and conveniently storing, for example, replacement bulbs, a lanyard or some other device.

In a preferred embodiment of the present invention, the device D includes an integral light assembly 12 at a location adjacent to and rearward of the hook shaped portion 4. Positioning of the hook shaped portion 4 adjacent the light assembly 12 functions to prevent damage to the light assembly while probing with the device, as in the case of probing among rocks or coral. The light assembly 12 includes a transparent lens 14 fitted to the body of the device in a location forward of the second hand grip 8. A bulb 16 is disposed in a housing (not shown) beneath the lens 14. A wire harness and conductors (not shown) are likewise disposed within the body of the device and provide an electrical connection between the bulb 16 and a power source. A switch mechanism 18, preferably in the form of a trigger switch, is incorporated into the widened hand grip 2. As is apparent, the disposition of the light assembly 12 may be modified from that shown in the drawings. For example, it may disposed more towards the distal end of the device D or even in place of the hook shaped portion 12. However, in a preferred embodiment the light assembly will not interfere with the ability of the end of the probe to be inserted into crevices or other small openings within a reef or underwater structure.

Electrical power for light assembly 12 is provided by batteries 20 secured in a battery housing 22 located interior of the body of the device D. The batteries 20 function to not only provide electrical power for the light bulb 16 but also act as a type of counterweight which, when disposed within the body region distal of the widened hand grip 2, serves to provide a balance against the weight of the widened hand grip 2 and therefore provide a device D having an overall weight distribution that is balanced from the hand grip 2 to the hook portion 4. A probe and illumination device having the balanced weight distribution of the present invention is more comfortably held by the diver with either one hand or both hands. The probe and illumination device D according to the present invention also reduces the likelihood of irretrievable loss of the device in the event it is accidentally dropped during underwater use. If accidentally dropped during underwater use the balanced weight distribution assists in maintaining the device is a generally horizontal position thereby slowing descent and improving the likelihood of recovery of the device by the diver. This is best shown in FIG. 6 where the device D is shown to maintain a generally horizontal alignment in water W. In one preferred embodiment, the balanced weight distribution is such that the device D will have a center of gravity located between widened hand grip 2 and second hand grip 8. As a result the device D is easily maintained in a horizontal position during use and not prone to overweighting at either the distal or proximate ends of the device.

The device D according to the present invention is preferably constructed from materials adapted to the marine environment to render the entire device resistant to leakage and corrosion. As is apparent, any of a variety of illumination members may used for producing light at the light assembly 12 including conventional light bulbs, halogen light bulbs, LED's or the like.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. An underwater probe and illumination device comprising:

a) a body, said body having a first end, a midsection and to a second end, said midsection is arcuate;

b) a hand grip, said hand grip disposed at said first end;

c) an illumination device, said illumination device disposed at about said second end;

d) said midsection having first diameter at about said first end and a second diameter at about said second end and a third diameter therebetween, said first diameter is greater than each of said second diameter and said third diameter; and e) a second hand grip, said second hand grip disposed on said midsection.

2. An underwater probe and illumination device as in claim 1 and further including:

a) a weighting member, said weight member disposed within said body at about said second end to increase the mass thereof.

3. An underwater probe and illumination device as in claim 2 and wherein:

a) said weighting member comprising a power source for said illumination device.

4. An underwater probe and illumination device as in claim 3 and wherein:

a) said power source comprising at least one electric battery.

5. An underwater probe and illumination device as in claim 1 and wherein:

a) said illumination device operatively associated with a switch mechanism, said switch mechanism provided in said hand grip.

6. An underwater prove and illumination device as in claim 1 and further including:

a) a hook member, said hook member extending from said second end.

7. An underwater prove and illumination device as in claim 1 and further including:

a) a storage region, said storage region provided in said hand grip.

8. An underwater prove and illumination device as in claim 1 and wherein:

a) said second hand grip is unitary with said midsection.

9. An underwater probe and illumination device comprising:

a) a tapered arcuate body extending from a first end to a second end, said tapered arcuate body first end having a diameter greater than the remaining portions thereof;

b) a first hand grip, said first hand grip disposed at said first end;

c) a probe, said probe extending from said second end;

d) a illumination device, said operatively associated with said second end; and e) a second hand grip, said second hand grip positioned adjacent said second end.

10. An underwater probe and illumination device as in claim 9 and further including:

a) a power source for said illumination device, said power source disposed within said tapered arcuate body at about said second end.

11. An underwater probe and illumination device as in claim 10 and wherein:

a) said power source comprising at least one electric battery.

12. An underwater probe and illumination device as in claim 10 and wherein:

a) said illumination device operatively associated with a switch mechanism, said switch mechanism provided in said first hand grip.

13. An underwater probe and illumination device comprising:

a) an arcuate body extending from a first end to a second end;

b) a hand grip, said hand grip disposed at said first end;

c) an illumination device, said illumination device disposed at about said second end; and d) a hook member, said hook member extending from said second end.

14. An underwater prove and illumination device as in claim 13 and further including:

a) a midsection, said midsection extending between said first end and said second end.

15. An underwater probe and illumination device as in claim 14 and further including:

a) a second hand grip, said second hand grip provided on said midsection.

16. An underwater probe and illumination device as in claim 15 and further including:

a) a weighting member, said weight member disposed within said arcuate body.

17. An underwater probe and illumination device as in claim 16 and wherein said weighting member comprising a power source for said illumination device.

* * * * *